US011848474B2

(12) United States Patent
Li et al.

(10) Patent No.: US 11,848,474 B2
(45) Date of Patent: Dec. 19, 2023

(54) COPLANAR WAVEGUIDE TRANSMISSION LINE AND DESIGN METHOD THEREOF

(71) Applicant: LANSUS TECHNOLOGIES INC., Shenzhen (CN)

(72) Inventors: Shulun Li, Shenzhen (CN); Jiashuai Guo, Shenzhen (CN)

(73) Assignee: LANSUS TECHNOLOGIES INC., Shenzhen (CN)

( * ) Notice: Subject to any disclaimer, the term of this patent is extended or adjusted under 35 U.S.C. 154(b) by 0 days.

(21) Appl. No.: 18/353,884

(22) Filed: Jul. 18, 2023

(65) Prior Publication Data

US 2023/0361444 A1 Nov. 9, 2023

Related U.S. Application Data

(63) Continuation of application No. PCT/CN2022/084437, filed on Mar. 31, 2022.

(30) Foreign Application Priority Data

Dec. 31, 2021 (CN) ..... 202111682905.8

(51) Int. Cl.

| | |
|---|---|
| ***H01P 3/00*** | (2006.01) |
| ***H01P 3/10*** | (2006.01) |
| ***H01P 5/10*** | (2006.01) |

(52) U.S. Cl.

CPC ..... *H01P 3/006* (2013.01); *H01P 3/10* (2013.01); *H01P 5/1015* (2013.01)

(58) Field of Classification Search

CPC ..... H01P 3/006; H01P 3/10; H01P 5/1015

See application file for complete search history.

(56) References Cited

U.S. PATENT DOCUMENTS

| | | | | |
|---|---|---|---|---|
| 6,501,352 | B1 * | 12/2002 | Koriyama | H01P 3/08 333/260 |
| 2006/0284699 | A1 * | 12/2006 | Weiske | H01P 5/085 333/33 |
| 2010/0253450 | A1 | 10/2010 | Kim et al. | |
| 2012/0056696 | A1 * | 3/2012 | Cheng | H01P 5/085 333/260 |

FOREIGN PATENT DOCUMENTS

| | | | |
|---|---|---|---|
| CN | 113422190 | A | 9/2021 |

* cited by examiner

*Primary Examiner* — Samuel S Outten

(57) ABSTRACT

A coplanar waveguide transmission line and a design method thereof are provided. The coplanar waveguide transmission line includes a first dielectric substrate, a center conductor strip, and two ground conductor strips. The first dielectric substrate has a first surface and a second surface opposite to each other. The center conductor strip and the ground conductor strips are stacked and fixed to the first surface. The center conductor strip includes a first segment and a second segment. A width of the first segment is greater than a width of the second segment, so that the first segment and the second segment form a step structure. A rectangular groove recessed toward the second surface is defined in the first surface, and a part of the center conductor strip is stacked and fixed to a side, distal from the second surface, of the rectangular groove to form a defected ground structure.

8 Claims, 8 Drawing Sheets

COPLANAR WAVEGUIDE TRANSMISSION LINE AND DESIGN METHOD THEREOF

TECHNICAL FIELD

The present disclosure relates to the field of transmission line technologies, and in particular to a coplanar waveguide transmission line and a design method for impedance matching in a coplanar waveguide transmission line.

BACKGROUND

As Wi-Fi 6 (IEEE802.11ax) technology has been widely applied, it puts forward increasingly high requirements for a transmission line operating at the 2.4 GHz and 5 GHz frequency bands. The transmission line is required to realize impedance matching in the two frequency bands and therefore is an important performance index. The impedance matching is mainly applied in a radio frequency transmission line, which allows all high-frequency microwave signals to be transmitted to a load end with almost no reflection to a source end, thereby enhancing energy efficiency. The transmission line is generally in an impedance matching mode of using a quarter-wave impedance transformer, a stepped-impedance transformer, a triangle impedance transformer, a trapezoidal impedance transformer, or branch load matching (including single-branch load and dual-branch load).

In the related art, the transmission line on an evaluation board (EVB) for testing a Wi-Fi 6 chip generally has a coplanar waveguide (CPW) transmission line structure. An end of the transmission line is connected to a subminiature version A (SMA) connector, and the other end of the transmission line is connected to the Wi-Fi 6 chip. Referring to FIG. 1 and FIG. 2, FIG. 1 is a schematic structural diagram of a coplanar waveguide transmission line in the related art; and FIG. 2 is a schematic diagram of a three-dimensional structure of part A as shown in FIG. 1. Specifically, the coplanar waveguide transmission line includes a dielectric substrate A1, a center conductor strip A2 configured to transmit a radio frequency signal, and two ground conductor strips A3 spaced on two opposite sides of the center conductor strip A2. The dielectric substrate A1 has a first surface and a second surface arranged opposite to each other. The center conductor strip A2 and the ground conductor strips A3 are stacked and fixed to the first surface. The center conductor strip A2 includes a first segment A21 configured to connect to the external SMA connector and a second segment A22 that extends from an end, distal from the SMA connector, of the first segment A21 and is configured to connect to the Wi-Fi 6 chip. A distance perpendicular to an extension direction from the first segment A21 toward the second segment A22 is defined as width, and a width of the first segment A21 is greater than a width of the second segment A22, to form a step structure, thereby realizing the impedance matching.

The coplanar waveguide transmission line in the related art uses the step structure for realizing the impedance matching. However, within the range of the Wi-Fi 6 frequency band, the reflection coefficient S11 of the coplanar waveguide transmission line in the related art has values of about 15 dB and 10 dB in the 2.4 GHz to 2.5 GHz and 5 GHz to 6 GHz frequency bands, which fails to meet the requirement of the EVB in the Wi-Fi 6 chip test. Besides, in consideration of a processing error and an actual electromagnetic loss, an actual test performance is even worse, thereby greatly affecting the test performance of the Wi-Fi 6 chip.

Therefore, it is necessary to provide a novel transmission line and method to solve the foregoing problems.

SUMMARY

In view of the deficiencies in the related art, the present disclosure provides a coplanar waveguide transmission line having good impedance matching and good transmission index, and a design method for impedance matching in a coplanar waveguide transmission line.

In order to solve the foregoing problems, a first aspect of the present disclosure provides a coplanar waveguide transmission line, including a first dielectric substrate, a center conductor strip configured to transmit a radio frequency signal, and two ground conductor strips spaced on two opposite sides of the center conductor strip. The first dielectric substrate includes a first surface and a second surface arranged opposite to each other. The center conductor strip and the ground conductor strips are stacked and fixed to the first surface. The center conductor strip includes a first segment configured to connect to an external SMA connector, and a second segment that extends from an end, distal from the SMA connector, of the first segment and is configured to connect to an external chip. A distance perpendicular to an extension direction of the first segment toward the second segment is defined as width, and a width of the first segment is greater than a width of the second segment, so that the first segment and the second segment form a step structure, to realize impedance matching. A rectangular groove recessed toward the second surface is defined in the first surface, and a part of the center conductor strip is stacked and fixed to a side, distal from the second surface, of the rectangular groove, so that the groove forms a defected ground structure, to realize impedance matching of the radio frequency signal in a preset frequency band.

Optionally, the first segment is stacked and fixed to a side, distal from the second surface, of the rectangular groove.

Optionally, a width of the rectangular groove is greater than the width of the first segment.

Optionally, a distance in the extension direction from the first segment toward the second segment is defined as length, and a length of the rectangular groove is equal to a length of the first segment.

Optionally, the coplanar waveguide transmission line further includes a metal ground layer stacked and fixed to the second surface, and a plurality of first metallized through holes passing through the first dielectric substrate. The plurality of the first metallized through holes respectively are connected to the ground conductor strips and the metal ground layer.

Optionally, the plurality of the first metallized through holes are arranged at intervals on two opposite sides of the center conductor strip.

Optionally, the plurality of the first metallized through holes are arranged at equal intervals.

Optionally, the coplanar waveguide transmission line further includes a second dielectric substrate stacked to a side, distal from the first dielectric substrate, of the metal ground layer, and a second metallized through hole passing through the second dielectric substrate and connected to the metal ground layer. The second metallized through hole is configured to be electrically connected with a ground pin in a pad of the SMA connector.

Optionally, the second metallized through hole is one of two second metallized through holes, and each of the two second metallized through holes is arranged directly opposite to one corresponding first metallized through hole among the plurality of the first metallized through holes.

A second aspect of the present disclosure provides a design method for impedance matching in a coplanar waveguide transmission line. The design method is based on the coplanar waveguide transmission line according to any one of the foregoing embodiments, and the design method includes the following steps:

S1: defining the rectangular groove in the first surface, and adjusting relative positions of the rectangular groove and the center conductor strip; and S2: adjusting a width and a length of the rectangular groove, to realize the impedance matching of the radio frequency signal in the preset frequency band.

Compared with the related art, according to the coplanar waveguide transmission line and the design method for impedance matching in the coplanar waveguide transmission line provided by the present disclosure, the rectangular groove is arranged in the first surface of the first dielectric substrate, and the part of the center conductor strip is stacked and fixed in the rectangular groove, so that the rectangular groove forms the defected ground structure, thereby realizing the impedance matching of the radio frequency signal in the Wi-Fi 6 frequency band. Specifically, the width and the length of the rectangular groove is capable of adjusting, to realize the impedance matching of the radio frequency signal in the preset frequency band. Optionally, the second dielectric substrate and the second metallized through holes are arranged, so as to allow the second metallized through holes to be electrically connected with the ground pins in the pad of the external SMA connector, which effectively enhances a degree of contact between the EVB and the SMA connector, thereby improving test performance of the EVB, especially the transmission index in a high frequency part of the 5 GHz to 6 GHz frequency band of the Wi-Fi 6 chip.

BRIEF DESCRIPTION OF THE DRAWINGS

The present disclosure is described below with reference to accompanying drawings. In conjunction with the accompanying drawings, the foregoing or other aspects of the present disclosure are made clearer and more readily understood. In the drawings.

DETAILED DESCRIPTION OF THE EMBODIMENTS

The specific embodiments of the present disclosure will be described in details below with reference to the accompanying drawings.

The specific embodiments described herein are specific implementations of the present disclosure, and are used to illustrate the concept of the present disclosure. They are explanatory and exemplary, and should not be interpreted as limiting the implementations and the scope of the present disclosure. In addition to the embodiments described herein, based on the contents disclosed in the claims and specifications of the present disclosure, those skilled in the art can adopt other technical solutions. Any substitution or modification made to the embodiments described herein is within the protection scope of the present disclosure.

One embodiment of the present disclosure provides a coplanar waveguide transmission line 100.

Figure 3:
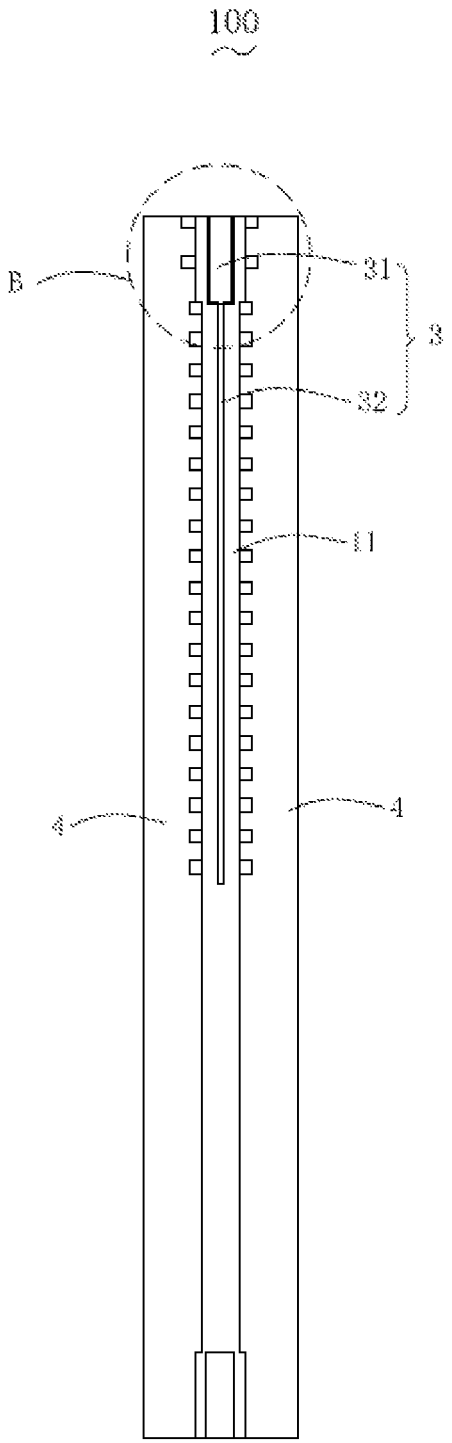
FIG. 3 is a structural schematic diagram of a coplanar waveguide transmission line according to one embodiment of the present disclosure.
Figure 4:
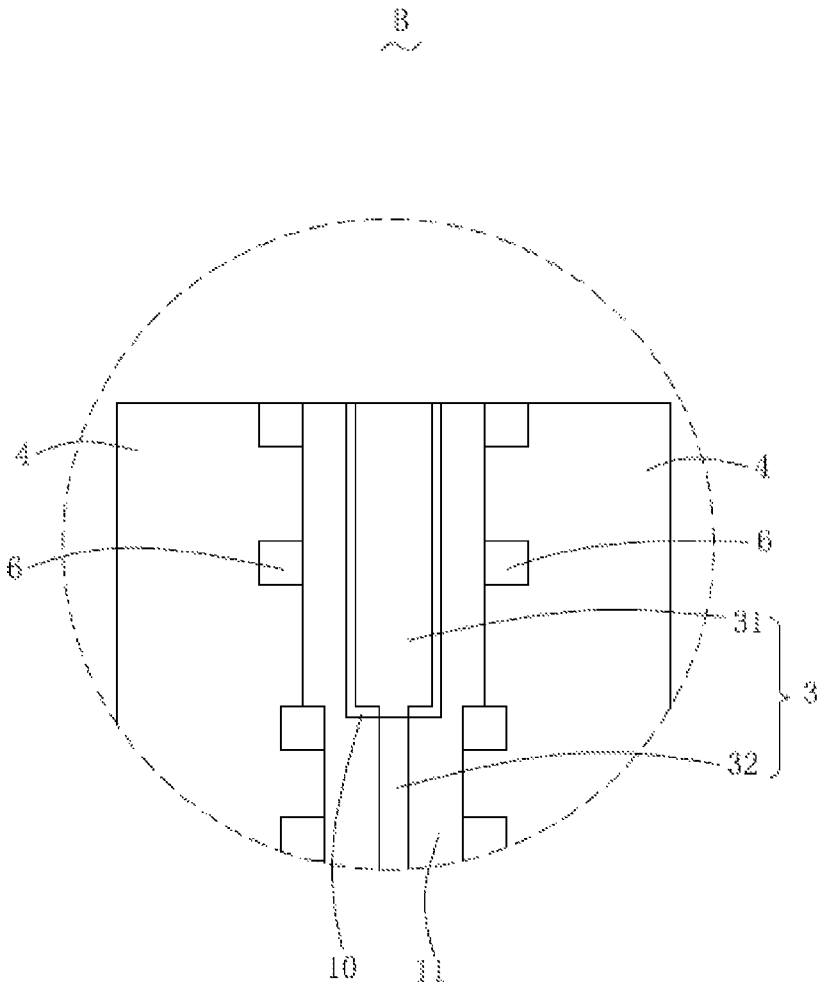
FIG. 4 is a schematic diagram of an enlarged view of part B as shown in FIG. 3.
Figure 5:
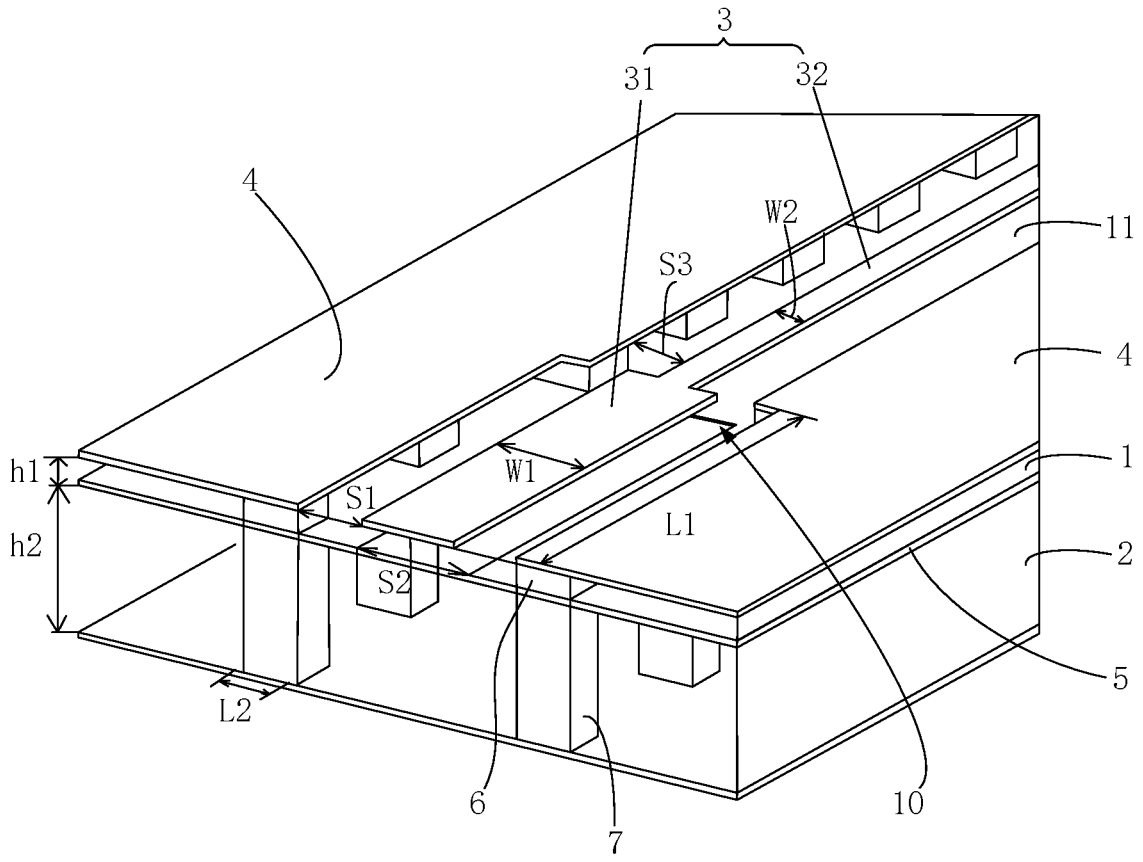
FIG. 5 is a schematic diagram of a three-dimensional structure of part B as shown in FIG. 3.

Referring to FIG. 3 to FIG. 5, FIG. 3 is a schematic structural diagram of a coplanar waveguide transmission line according to one embodiment of the present disclosure. FIG. 4 is a schematic diagram of an enlarged view of part B as shown in FIG. 3; and FIG. 5 is a schematic diagram of a three-dimensional structure of part B as shown in FIG. 3.

The coplanar waveguide transmission line 100 includes a first dielectric substrate 1, a second dielectric substrate 2, a center conductor strip 3, ground conductor strips 4, a metal ground layer 5, first metallized through holes 6, and second metallized through holes 7.

The first dielectric substrate 1 has a first surface 11 and a second surface (not shown in the drawings) arranged opposite to each other.

The second dielectric substrate 2 is stacked to a side of the second surface of the first dielectric substrate 1. Specifically, the second dielectric substrate 2 is stacked to a side, distal from the first dielectric substrate 1, of the metal ground layer 5. A thickness of the second dielectric substrate 2 is greater than a thickness of the first dielectric substrate 1.

The center conductor strip 3 is configured to transmit a radio frequency signal. The center conductor strip 3 is stacked and fixed to the first surface 11.

Specifically, the center conductor strip 3 includes a first segment 31 that is configured to connect to an external SMA connector, and a second segment 32 that extends from an end, distal from the SMA connector, of the first segment 31 and is configured to connect to an external chip.

The ground conductor strips 4 are stacked and fixed to the first surface 11. There are two ground conductor strips 4, and the two ground conductor strips 4 are spaced on two opposite sides of the center conductor strip 3.

A distance perpendicular to an extension direction of the first segment 31 toward the second segment 32 is defined as width. A width of the first segment 31 is W1, and a width of the second segment 32 is W2. The width W1 of the first segment 31 is greater than the width W2 of the second segment 32, so that the first segment 31 and the second segment 32 form a step structure, thereby realizing the impedance matching.

In order to better realize the impedance matching of the radio frequency signal in the Wi-Fi 6 frequency band, the coplanar waveguide transmission line 100 is provided with a rectangular groove 10. Specifically, the rectangular groove 10 recessed toward the second surface is defined in the first surface 11. A part of the center conductor strip 3 is stacked and fixed to a side, distal from the second surface, of the rectangular groove 10. The first segment 31 is stacked and fixed to the side, distal from the second surface, of the rectangular groove 10, so that the rectangular groove 10 forms a defected ground structure, thereby realizing the impedance matching of the radio frequency signal in a preset frequency band. The preset frequency band is the Wi-Fi 6 frequency band. Specifically, the Wi-Fi 6 frequency band is in a range of 1 GHz to 7 GHz.

In some embodiments, a width of the rectangular groove 10 is defined as S2. The width S2 of the rectangular groove 10 is greater than the width W1 of the first segment 31. That is, an orthographic projection of the first segment 31 along a direction of the first surface 11 to the second surface is completely within the rectangular groove 10. Optionally, the first segment 31 is located at a center of the rectangular groove 10.

A distance in the extension direction of the first segment 31 toward the second segment 32 is defined as length. A length of the rectangular groove 10 is L1. The length of the rectangular groove 10 is equal to a length of the first segment 31, which is not limited herein. Adjusting the length L1 of the rectangular groove 10 is beneficial to the impedance matching.

The metal ground layer 5 is stacked and fixed to the second surface. The metal ground layer 5 is configured to be connected to ground.

The first metallized through holes 6 pass through the first dielectric substrate 1. The first metallized through holes 6 are respectively connected to the ground conductor strips 4 and the metal ground layer 5.

There are a plurality of first metallized through holes 6. In some embodiments, the plurality of first metallized through holes 6 are arranged at intervals on two opposite sides of the center conductor strip 3. This structure facilitates the transmission of the radio frequency signal through the center conductor strip 3 and prevents signal interference.

In some embodiments, the plurality of first metallized through holes 6 are arranged at equal intervals. This structure improves the ground effect of the ground conductor strips 4 and the metal ground layer 5, which prevents a voltage difference, thereby facilitating the transmission of the radio frequency signal through the center conductor strip 3 and preventing signal interference.

The second metallized through holes 7 are configured to be electrically connected with ground pins in a pad of the SMA connector. The second metallized through holes 7 pass through the second dielectric substrate 2 and are connected to the metal ground layer 5.

Specifically, there are two second metallized through holes 7. Each of the two second metallized through holes 7 is arranged directly opposite to one corresponding first metallized through hole 6. The two second metallized through holes 7 are connected to the corresponding first metallized through holes 6 by the metal ground layer 5. That is, the ground pins in the pad of the SMA connector are connected to the ground conductor strips 4 sequentially by the second metallized through holes 7, the metal ground layer 5, and the first metallized through holes 6. This structure effectively improves the degree of contact between the EVB and the SMA connector, thereby enhancing the test performance of the EVB, especially the transmission index tested in the high frequency part of the 5 GHz to 6 GHz frequency band of the Wi-Fi 6 chip.

In order to verify that the coplanar waveguide transmission line 100 has good impedance matching and good transmission index, the curves of a relation between reflection coefficient amplitude and frequency of the coplanar waveguide transmission line in the related art and the coplanar waveguide transmission line 100 provided by the present disclosure are compared below.

Figure 1:
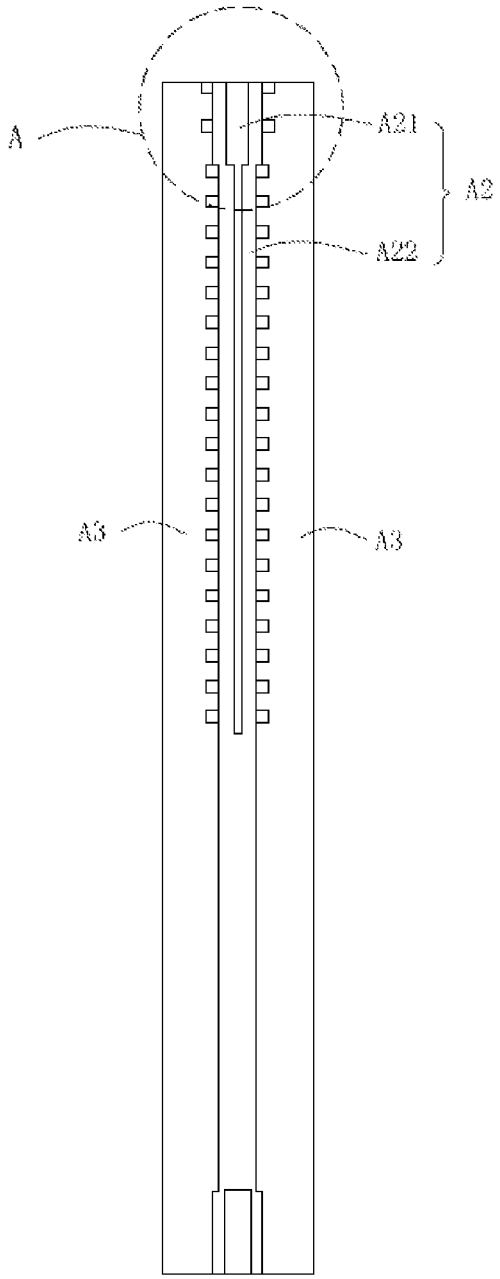
FIG. 1 is a structural schematic diagram of a coplanar waveguide transmission line in the related art.
Figure 2:
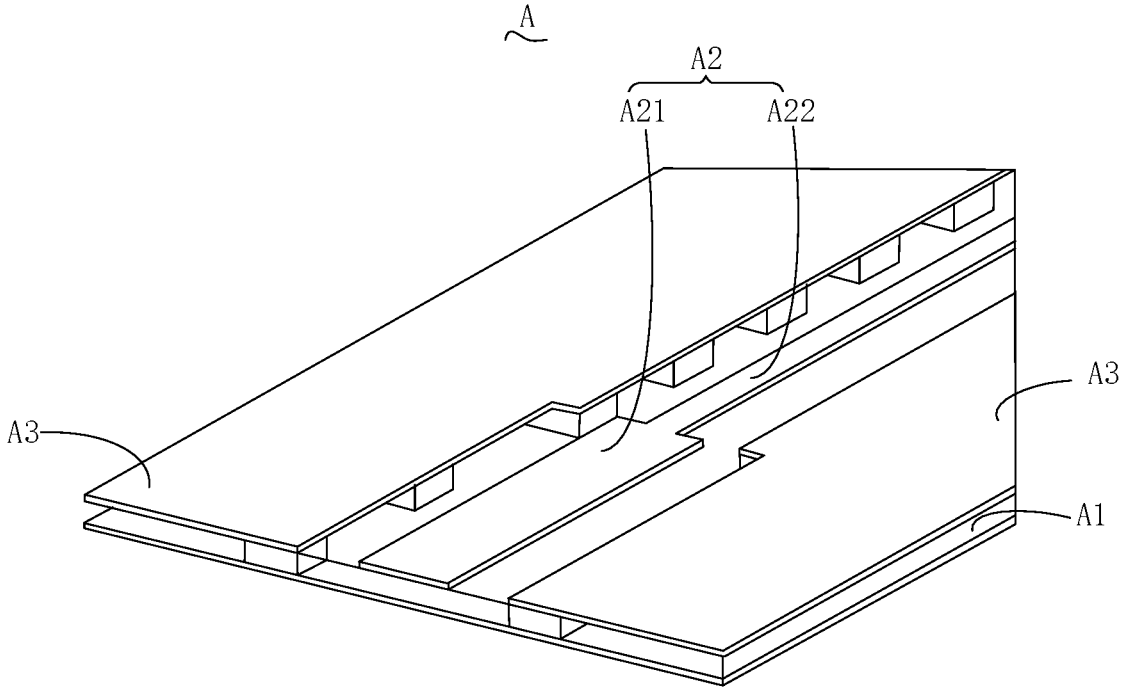
FIG. 2 is a schematic diagram of a three-dimensional structure of part A as shown in FIG. 1.

Referring to the structure of the coplanar waveguide transmission line in the related art as shown in FIG. 1 and FIG. 2, the dielectric substrate A1 uses a dielectric material D_FR4 that has a dielectric constant ε=4.4 and a height of 6.6 mil, the width of the first segment A21 is 13.77 mil, and a gap S1 between the first segment A21 and the ground conductor strips A3 is 19 mil. The first segment A21 is a transmission line connected to a chip pad, and accordingly is a relatively narrow line having high impedance. In order to realize the impedance matching of 50 ohms to high impedance, the coplanar waveguide transmission line in the related art has a step structure.

Figure 6:
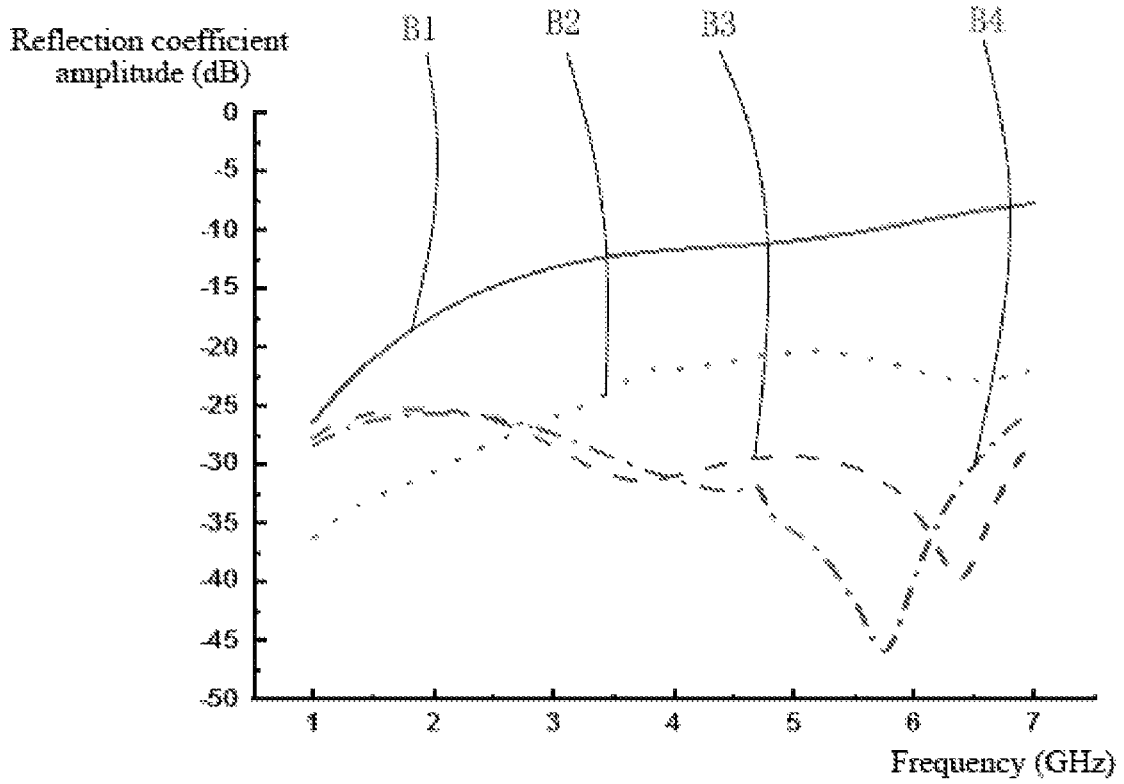
FIG. 6 is a schematic diagram showing comparison curves of a relation between reflection coefficient amplitude and frequency through simulation of the coplanar waveguide transmission line according to the present disclosure.

Referring to FIG. 6, it shows the comparison curves of a relation between reflection coefficient amplitude and frequency through simulation of the coplanar waveguide transmission line according to the present disclosure. In the figure:

- B1 is a curve of a relation between reflection coefficient amplitude and frequency obtained through CPW simulation;
- B2 is a curve of a relation between reflection coefficient amplitude and frequency in a case that the length of the rectangular groove 10 is L1=104 mil and the width of the rectangular groove 10 is changed to S2=34 mil;
- B3 is a curve of a relation between reflection coefficient amplitude and frequency in a case that the length of the rectangular groove 10 is L1=104 mil and the width of the rectangular groove 10 is changed to S2=38 mil; and
- B4 is a curve of a relation between reflection coefficient amplitude and frequency in a case that the length of the rectangular groove 10 is L1=114 mil and the width of the rectangular groove 10 is changed to S2=34 mil.

It can be seen from the comparison of the curves B1 to B4, in the case that the length L1=104 mil of the rectangular groove 10 remains unchanged, and the width S2 of the rectangular groove 10 is changed, the reflection coefficient S11 becomes better as the width S2 increases. In the case that the width S2 of the rectangular groove 10 remains unchanged, the performance becomes worse as the length L1 of the rectangular groove 10 decreases. It can be seen, from the simulation data, that reasonable adjustment of the size of the rectangular groove 10 can realize the impedance matching in the 2.4 GHz and 5 GHz frequency bands. The value of S11 is basically maintained below −25 dB and even reaches about −30 dB, which meets the requirement of the EVB test environment of the chip.

In the coplanar waveguide transmission line 100 provided by the present disclosure, the thickness of the first dielectric substrate 1 is h1=6.6 mil; the thickness of the second dielectric substrate 2 is h2=40.5 mil; the gap between the first segment 31 and the ground conductor strips 4 is S1=19 mil; the gap between the second segment 32 and the ground conductor strips 4 is S3=20 mil; the width of the first segment 31 is W1=13.77 mil; the width of the rectangular groove 10 is S2=34 mil; the length of the rectangular groove 10 is L1=114 mil; the second metallized through holes 7 are square, and the width of the second metallized through holes 7 is L2=16 mil.

Figure 7:
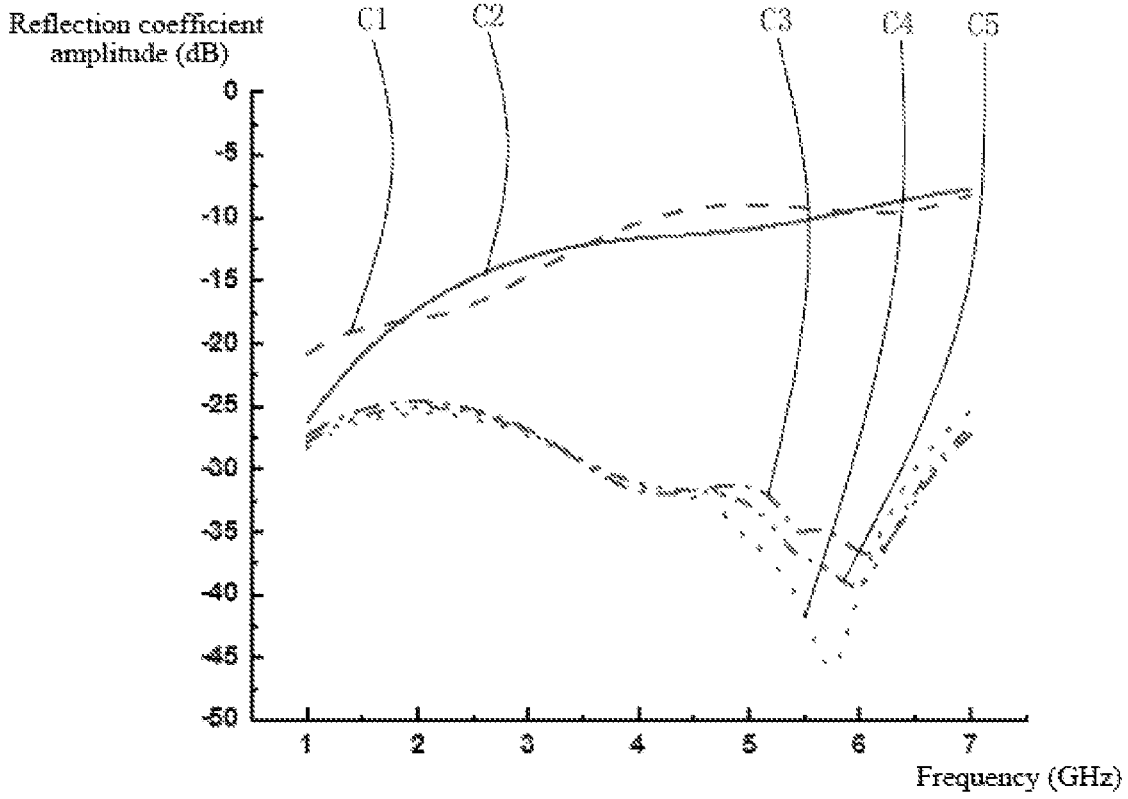
FIG. 7 is a schematic diagram showing comparison curves of a relation between reflection coefficient amplitude and frequency through simulation and actual test of the coplanar waveguide transmission line according to the present disclosure.

Referring to FIG. 7, it shows the comparison curves of a relation between reflection coefficient amplitude and frequency through simulation and actual test of the coplanar waveguide transmission line according to the present disclosure. In the figure:

C1 is a curve of a relation between reflection coefficient amplitude and frequency obtained through EVB test data;

C2 is a curve of a relation between reflection coefficient amplitude and frequency obtained through CPW simulation;

C3 is a curve of a relation between reflection coefficient amplitude and frequency through test data in a case that the length of the rectangular groove 10 is L1=114 mil, the width of the rectangular groove 10 is changed to S2=34 mil, and the structure of the second metallized through holes 7 is modified;

C4 is a curve of a relation between reflection coefficient amplitude and frequency through CPW simulation in a case that the length of the rectangular groove 10 is L1=114 mil, the width of the rectangular groove 10 is changed to S2=34 mil, and there is no second metallized through holes 7; and C5 is a curve of a relation between reflection coefficient amplitude and frequency through test data in a case that the length of the rectangular groove 10 L1=114 mil, the width of the rectangular groove 10 is changed to S2=34 mil, and there is no second metallized through holes 7.

By comparing the curves C1 to C5 with FIG. 4, the following can be concluded:

In the case that the length L1=104 mil of the rectangular groove 10 remains unchanged, and the width S2 of the rectangular groove 10 is changed, the reflection coefficient amplitude (namely the value of S11) becomes better as the width increases. In the case that the width S2 of the rectangular groove 10 remains unchanged, the performance becomes worse as the length L1 of the rectangular groove 10 decreases.

By reasonably adjusting the size of the rectangular groove 10, the impedance matching in the 2.4 GHz and 5 GHz frequency bands can be realized. The value of S11 is basically maintained below −25 dB and even reaches about −30 dB, which perfectly meets the requirement of the EVB test environment of the chip.

In addition, it can be seen from the measurement data that the arrangement of the second metallized through holes 7 has no influence on the performance in the low-frequency part, but contributes to the enhancing the performance in the high-frequency part. Especially, the test effect is significant in the 5 GHz to 6 GHz frequency band of the Wi-Fi 6 chip. Therefore, the coplanar waveguide transmission line 100 has good transmission performance.

The present disclosure further provides a design method for impedance matching in a coplanar waveguide transmission line.

The design method for impedance matching in a coplanar waveguide transmission line is based on the coplanar waveguide transmission line 100.

Figure 8:
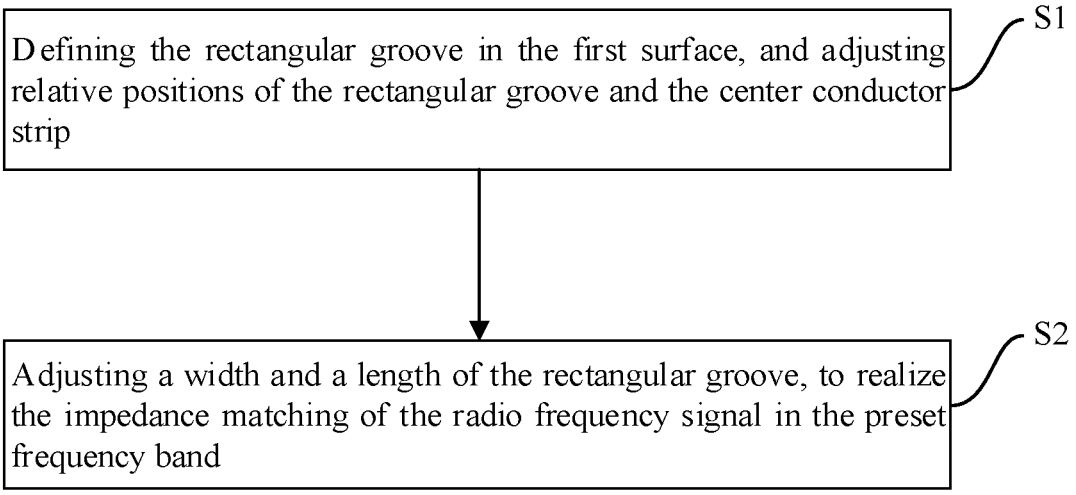
FIG. 8 is a flowchart of a design method for impedance matching in a coplanar waveguide transmission line according to one embodiment of the present disclosure.

Referring to FIG. 8, it is a flowchart of the design method for impedance matching in the coplanar waveguide transmission line according to one embodiment of the present disclosure. The design method for impedance matching in the coplanar waveguide transmission line includes the following steps:

S1. defining the rectangular groove 10 in the first surface 11, and adjust relative positions of the rectangular groove 10 and the center conductor strip 3.

S2. adjusting the width and the length of the rectangular groove 10, to realize the impedance matching of the radio frequency signal in the preset frequency band.

Compared with the related art, according to the coplanar waveguide transmission line and the design method for impedance matching in the coplanar waveguide transmission line provided by the present disclosure, the rectangular groove is arranged in the first surface of the first dielectric substrate, and the part of the center conductor strip is stacked and fixed in the groove, so that the groove forms a defected ground structure, thereby realizing the impedance matching of the radio frequency signal in the preset frequency band. Specifically, the width and the length of the rectangular groove can be adjusted, to realize the impedance matching of the radio frequency signal in the preset frequency band. Optionally, the second dielectric substrate and the second metallized through holes are arranged, so as to allow the second metallized through holes to be electrically connected with the ground pins in the pad of the external SMA connector, which effectively enhances the degree of contact between the EVB and the SMA connector, thereby improving the test performance of the EVB, especially the transmission index in the high frequency part of the 5 GHz to 6 GHz frequency band of the Wi-Fi 6 chip.

The foregoing embodiments with reference to the accompanying drawings are merely used to illustrate the scope of the present disclosure and not to limit the scope of the present disclosure. It will be appreciated that modifications or equivalent substitutions to the present disclosure without departing from the spirit and scope of the present disclosure should be within the scope of the present disclosure. In addition, unless the context otherwise requires, any term that appears in the singular include the plural, and vice versa. Moreover, unless specifically stated, all or a part of any embodiment may be used in conjunction with all or a part of any other embodiment.

What is claimed is:

1. A coplanar waveguide transmission line, comprising:

a first dielectric substrate;

a center conductor strip;

two ground conductor strips;

a metal ground layer; and a plurality of first metallized through holes;

wherein the center conductor strip is configured to transmit a radio frequency signal, the two ground conductor strips are spaced on two opposite sides of the center conductor strip; the first dielectric substrate comprises a first surface and a second surface arranged opposite to each other, the center conductor strip and the ground conductor strips are stacked and fixed to the first surface; and the center conductor strip comprises:

a first segment; and a second segment;

the first segment is configured to connect to an external subminiature version A (SMA) connector, and the second segment extends from an end, distal from the SMA connector, of the first segment and configured to connect to an external chip;

a distance perpendicular to an extension direction of the first segment toward the second segment is defined as width, and a width of the first segment is greater than a width of the second segment, to allow the first segment and the second segment to form a step structure, so as to realize impedance matching;

a rectangular groove recessed toward the second surface is defined in the first surface;

a part of the center conductor strip is stacked and fixed to a side, distal from the second surface, of the rectangular groove, to allow the rectangular groove to form a defected ground structure, so as to realize impedance matching of the radio frequency signal in a preset frequency band;

the metal ground layer is stacked and fixed to the second surface, the plurality of the first metallized through holes pass through the first dielectric substrate, and the plurality of the first metallized through holes are respectively connected to the ground conductor strips and the metal ground layer; and the plurality of the first metallized through holes are arranged at intervals on two opposite sides of the center conductor strip.

2. The coplanar waveguide transmission line according to claim 1, wherein the first segment is stacked and fixed to the side, distal from the second surface, of the rectangular groove.

3. The coplanar waveguide transmission line according to claim 2, wherein a width of the rectangular groove is greater than the width of the first segment.

4. The coplanar waveguide transmission line according to claim 3, wherein a distance in the extension direction from the first segment toward the second segment is defined as length, and a length of the rectangular groove is equal to a length of the first segment.

5. The coplanar waveguide transmission line according to claim 1, further comprising:

a second dielectric substrate; and a second metallized through hole;

wherein the second dielectric substrate is stacked to a side, distal from the first dielectric substrate, of the metal ground layer away, the second metallized through hole passes through the second dielectric substrate and is connected to the metal ground layer; and the second metallized through hole is configured to be electrically connected with a ground pin in a pad of the SMA connector.

6. The coplanar waveguide transmission line according to claim 5, wherein the second metallized through hole is one of two second metallized through holes, and each of the two second metallized through holes is arranged directly opposite to one corresponding first metallized through hole among the plurality of the first metallized through holes.

7. The coplanar waveguide transmission line according to claim 1, wherein the plurality of the first metallized through holes are arranged at equal intervals.

8. A design method for impedance matching in a coplanar waveguide transmission line, wherein the design method is based on the coplanar waveguide transmission line according to claim 1, comprising:

S1: defining the rectangular groove in the first surface, and adjusting relative positions of the rectangular groove and the center conductor strip; and S2: adjusting a width and a length of the rectangular groove, to realize the impedance matching of the radio frequency signal in the preset frequency band.

* * * * *